US005739471A

United States Patent [19]

Burisch

[11] Patent Number: 5,739,471

[45] Date of Patent: Apr. 14, 1998

[54] HIGH-FREQUENCY CABLE

[75] Inventor: Hans Joachim Burisch, Wuppertal, Germany

[73] Assignee: Draka Deutschland GmbH & Co. KG, Germany

[21] Appl. No.: 347,461

[22] PCT Filed: Mar. 9, 1994

[86] PCT No.: PCT/DE94/00242

§ 371 Date: Jan. 24, 1995

§ 102(e) Date: Jan. 24, 1995

[87] PCT Pub. No.: WO94/23434

PCT Pub. Date: Oct. 13, 1994

[30] Foreign Application Priority Data

Apr. 1, 1993 [DE] Germany ..... 43 10 662.5

[51] Int. Cl.[6] ..... H01B 7/34

[52] U.S. Cl. ..... 174/102 R; 174/103

[58] Field of Search ..... 174/102 R, 103, 174/36, 102 SP; 333/243; 338/214

[56] References Cited

U.S. PATENT DOCUMENTS

| | | | |
|---|---|---|---|
| 3,643,007 | 2/1972 | Roberts et al. | 174/106 X |
| 3,896,261 | 7/1975 | Cole | 174/115 |
| 4,847,448 | 7/1989 | Sato | 174/103 |
| 4,960,965 | 10/1990 | Redmon et al. | 174/102 R |
| 4,970,352 | 11/1990 | Satoh | 174/106 R X |
| 5,304,739 | 4/1994 | Klug et al. | 174/102 R |

FOREIGN PATENT DOCUMENTS

| | | |
|---|---|---|
| 0169906 | 5/1986 | European Pat. Off. . |
| 1948361 | 10/1966 | Germany . |
| 2654846 | 6/1978 | Germany . |
| 9109958 | 3/1987 | Germany . |
| 246399 | 11/1991 | Germany . |
| 9109958 | 11/1991 | Germany . |
| 2049262 | 12/1980 | United Kingdom . |

*Primary Examiner*—Kristine L. Kincaid
*Assistant Examiner*—Chau N. Nguyen
*Attorney, Agent, or Firm*—Reising, Ethington, Barnard & Perry

[57] ABSTRACT

In order to insure a constantly superior shielding effect for a high-frequency cable over a broad frequency range, the shield consists of a metal foil (3) which is shaped to form a tube and extends axially parallel as well as a number of electrically conductive wires (4) which are connected electrically with the foil (4) and in essence also extend axially parallel. A high-frequency cable constructed in this fashion is protected from interference over a broad frequency range and has a high tolerance against electromagnetic interference. A HF line of this type is particularly suitable as an antenna line, in particular in motor vehicles.

4 Claims, 1 Drawing Sheet

HIGH-FREQUENCY CABLE

FIELD OF THE INVENTION

The invention pertains to a high-frequency cable; more particularly, it relates to coaxial cables with high frequency shielding.

BACKGROUND OF THE INVENTION

A high-frequency or HF cable of this type may serve as a so-called antenna line for transmitting corresponding radio and television signals. In its simplest form, this line consists of an inner conductor, an insulation, an outer conductor and a sheathing.

It is a known procedure to construct the outer conductor which also acts as a shield of several layers. It is also known to apply a braiding consisting of individual wires onto a longitudinally extending metal foil which is shaped such that it forms a closed tube. In this way, the wires should extend over the periphery of the insulation within regular distances of each other. The wires in general extend parallel to each other in two bunches which intersect and form helixes around-the insulation and/or the inner conductor. Single-braided coverings or double braided coverings, so-called dummy braidings [unconfirmed translation], extend around the insulation in a similar fashion.

However, shields and/or outer conductors of this type are associated with high manufacturing costs due to the relatively slow manufacturing process, e.g., braiding or spinning. In addition, this type of outer conductor also requires so-called optimized braidings in order to attain a superior shielding effect over a certain frequency range, namely a relatively narrow frequency range.

The use of longitudinally extending shielding wires for shielding audio signals is known from European Patent No. 0,169,906 A1, FIG. 1. The arrangement of wires which are wound on top of a shielding sheath consisting of electrically conductive plastic in helical fashion and serve as contact conductors in order to shield bioelectronic signals is known from German Patent No. 2,654,846 A1, FIG. 1*a*. However, arrangements of this type are unable to attain the desired effects.

German Patent No. 1,948,361 U1 discloses an electric cable in which the shield consists of a number of parallel extending conducting wires and a foil which is provided with a metal on its surface which faces the wire layer. The manufacture of this relatively stiff cable is associated with high costs, and this particular cable may not be used as an HF cable.

SUMMARY OF THE INVENTION

The invention is based on the objective to design a high-frequency cable in such a way that it may be manufactured in a rapid and simple fashion. In addition, the shielding effect should be effective over a relatively broad frequency range.

The invention in principle may be considered for all electronic and optoelectronic cables in which it is important to attain a superior shielding effect over a broad frequency range.

The new HF cable provides a surprisingly superior shielding effect: the shielding effect practically remains constantly superior within a particularly broad frequency range. Consequently, broad-band interferences are shielded in a much superior fashion. It is, for example, possible to eliminate interference caused by the ignition of an internal combustion engine. Interference caused by signal transmissions (EMV) are minimized which, for example, is particularly favorable for a radiotelephone in a motor vehicle. In addition, the new arrangement may be further processed in a very superior fashion, in particular for electrical contact. When the sheath is removed, the foil may be removed at the same time, and the longitudinal wires maintain their integrity in order to facilitate contacting.

The number, distribution and thickness of the individual wires must be adapted to the requirements of the particular case, namely also with respect to the foil thickness.

BRIEF DESCRIPTION OF THE DRAWING

One embodiment of the invention is illustrated in the FIGURE and described in detail below.

DETAIL OF THE DESCRIPTION

Figure 1:
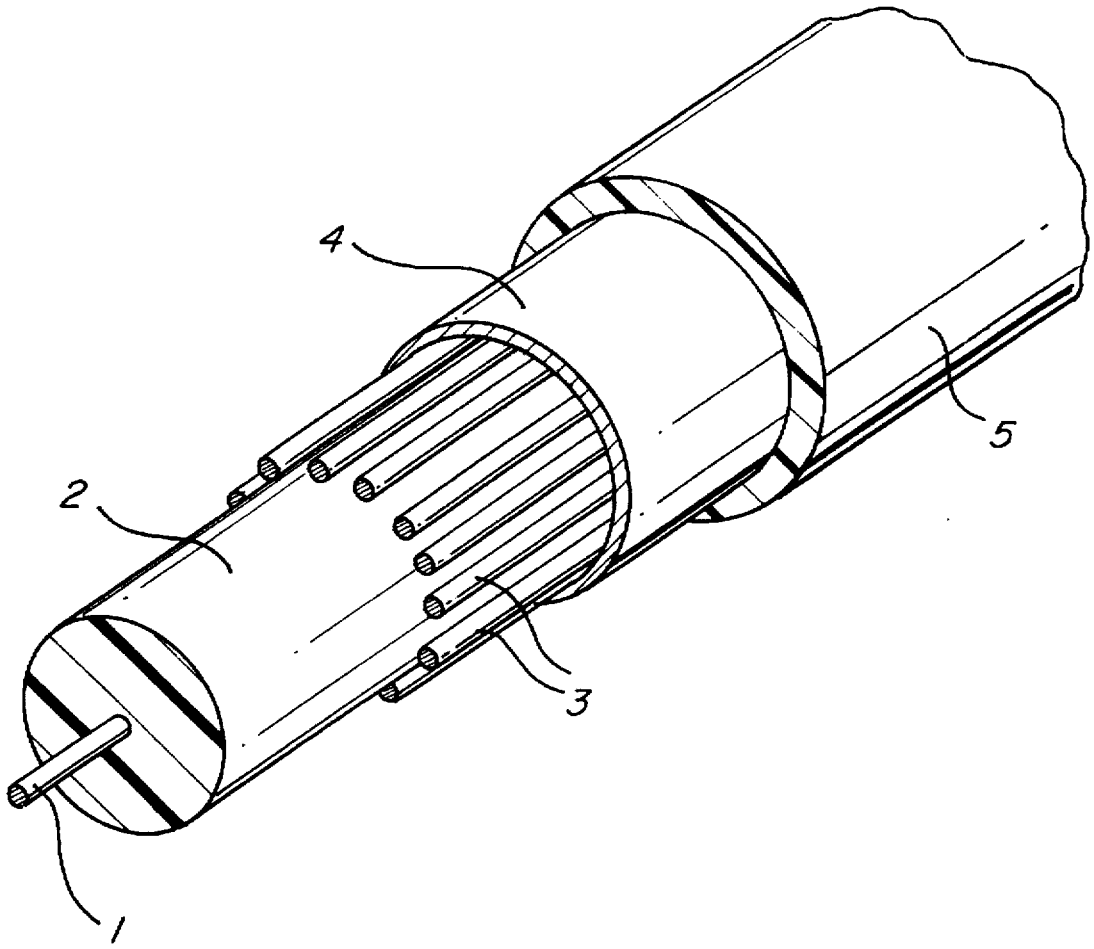

The inner conductor 1 is constructed as a single wire consisting of copper which has a diameter of no more than 0.26 mm. E-CU F21-V1 according to DIN 40.500 T5 is selected as the material.

The insulation 2 consists of a cellular polyethylene with a wall thickness of 1.25 mm (nominal value) and an outer diameter of 2.9±0.1 mm.

The outer conductor (shield) consists of wires 3 which extend axially parallel to the inner conductor 1, i.e., approximately 18 such wires. The material and the individual diameter of the wires correspond to the inner conductor 1. The outer conductor (shield) in addition comprises a conducting foil 4 which extends axially parallel to the inner conductor 1. The wires 3 are spaced from each other to provide a visual covering of the foil 4 that is in the range of 10–80% of the area of the inner surface of the foil. The foil 4 consists of an aluminum and PVC layer which has a width of 15 mm and a thickness of 0.05 mm. The aluminum layer faces the wires 3 and forms a closed tube. A sheath 5 is extruded onto the foil 4. Polyvinyl chloride (PVC) is selected as the material for this purpose. The wall thickness is 0.5 mm (nominal value) and the outer diameter is 5.0±0.2 mm. The sheath 5 is rigidly connected to the PVC layer of the foil 4 due to the extrusion heat.

The described high-frequency cable serves as an electric line in a motor vehicle, namely as an antenna line for an automobile radio. It is temperature resistant (3000 h) within a range between −25° C. and +90° C. It may easily be connected to the antenna as well as a connecting plug and has the following electric parameters: capacity: 32±2 pF/m; shield damping: greater than 60 dB; transmission loss (100 MHz): less than 15 dB/100 m.

I claim:

1. A high frequency cable comprising:

a central conductor, a layer of insulation surrounding said central conductor, an outer conductor comprising a plurality of wires disposed around said layer of insulation, an electrically conductive tubular foil having an inner surface disposed around said outer conductor and connected electrically to said plurality of wires, a layer of plastic having an inner surface disposed around said foil, and a sheath of plastic disposed around said layer of plastic, said plurality of wires being arranged parallel to each other and extending substantially parallel to said central conductor with a deviation not greater than five degrees, the wires being distributed around the circumference of the foil with equal spacing with the wires spaced apart so that the visual covering of the inner surface of said foil is between ten and eighty percent of the area of said surface, the foil being a metallized formation on the inner surface of said layer of plastic.

2. A cable as defined in claim 1 wherein the visual covering of the inner surface of said foil is between twenty and forty percent.

3. A cable as defined in claim 1 wherein the foil is made of one of the following metals:

aluminum, an aluminum alloy, copper and a copper alloy.

4. A cable as defined in claim 1 wherein the wires are made of one of the following metals:

copper, a copper alloy and a silver plated copper.

* * * * *